United States Patent [19]

Cuttler

[11] Patent Number: 4,516,418

[45] Date of Patent: May 14, 1985

[54] SEPARABLE HOLDER FOR KEYS AND THE LIKE

[75] Inventor: Luis Cuttler, Mexico City, Mexico

[73] Assignee: FAOSA - Fabrica de Armazones Opticos, S.A., Mexico City, Mexico

[21] Appl. No.: 427,554

[22] Filed: Sep. 29, 1982

[51] Int. Cl.[3] ..... A47G 29/10

[52] U.S. Cl. ..... 70/456 R; 24/3 K; 24/599; 24/698; 403/334

[58] Field of Search ..... 70/456 R, 457, 458, 70/459, 460; 24/3 K, 49 K, 589, 599, 702, 647, 656, 698, 614, 615; 411/308-311; 403/334

[56] References Cited

U.S. PATENT DOCUMENTS

| | | | |
|---|---|---|---|
| 1,456,931 | 5/1923 | Parker | 24/698 X |
| 2,121,230 | 6/1938 | Hamon | 403/334 |
| 3,132,395 | 5/1964 | Luketa | 24/599 |
| 3,280,438 | 10/1966 | Luketa | 24/698 X |
| 3,496,982 | 2/1970 | St. Pierre | 24/698 X |
| 3,542,384 | 11/1970 | Speed | 403/334 X |
| 3,899,955 | 8/1975 | Selch | 403/334 X |

*Primary Examiner*—Robert L. Wolfe
*Assistant Examiner*—Lloyd A. Gall
*Attorney, Agent, or Firm*—Fulwider, Patton, Rieber, Lee & Utecht

[57] ABSTRACT

A holder with a block-like, flat-sided main body carrying a key-holding ring at one end and having a C-shaped opposite end portion to which a ring-like detachable body is loosely but securely coupled. The detachable body is relatively thick and has a V-shaped notch in its outside surface, and the C-shaped portion has a relatively narrow passage extending from a central opening to one side edge of the main body, a finger on one side of the passage having a V-shaped end that is sized and shaped to pass the notched portion of the ring into the opening, with a non-jamming interference fit. A second key-holding ring is secured to the detachable body at a location ninety degrees from the notch, to tend to hold the notch away from the passage.

7 Claims, 5 Drawing Figures

SEPARABLE HOLDER FOR KEYS AND THE LIKE

BACKGROUND OF THE INVENTION

This invention relates to holders for keys and the like, and relates more particularly to key holders of the type in which two key-holding parts normally are secured together as a unitary holder, but are separable to detach one key-holding part from the other for separate use.

Separable key holders have been known in other forms, and typically comprise two parts that carry key-holding rings, and a latch for securing the two parts releasably together. The latches have been in the form of relatively complicated and difficult-to-grasp mechanical latches, or interfitting parts that are separable when manipulated into one particular relationship. The present invention is of the latter type, and is an improvement over prior separable holders of this general type.

SUMMARY OF THE INVENTION

The present invention resides in an improved separable holder for keys and the like that is relatively quick and easy to operate, with parts that are easy to grasp and manipulate into the "release" position, but which at the same time normally remain joined securely together and are highly unlikely to be inadvertently separated. Moreover, the easily grasped parts of the holder are of substantial size and thickness, for a very substantial "feel" and attractive appearance, but are composed of lightweight material for ease and comfort.

More specifically, the holder of the invention comprises an elongated, flat-sided main body carrying one of the key-holding means at one end and having a generally C-shaped opposite end portion forming a generally circular opening and a narrow passage extending from the opening through a side edge of the body, and a relatively thick annular detachable body carrying the second key-holding means and having a portion of reduced thickness, herein a notched side, for sliding through the passage and into the circular opening, to couple the two bodies together. The second key-holding means is positioned on the detachable body to cause the notched side to move away from the passage in normal use, thereby to reduce the chance of inadvertent detachment.

The preferred configuration of the detachable body is a circular ring that is thicker than the width of the passage except at the notch, and thin enough to fit loosely in the hole of the main body and swing on an arcuate rib which forms the end of the main body. The notch preferably is V-shaped and located in the external surface of the ring. One side of the passage preferably is defined by a portion of the main body that forms a finger with a V-shaped end, sized to pass the notched side of the ring through the passage with a tight sliding fit. The angle of the "V" of the notch is different from the angle of the "V" of the finger, to avoid flat surface-to-surface jamming contact. Both bodies preferably are composed of hard plastic, such as acrylic, which may be cast economically in the desired shapes. For design balance and convenience, the two holes may be of substantially the same size, with the ring wall and the arcuate rib of the main body also substantially the same size.

Other aspects and advantages of the invention will become apparent from the following detailed description, taken in conjunction with the accompanying drawings showing the presently preferred embodiment of the invention.

DETAILED DESCRIPTION OF THE PREFERRED EMBODIMENT

Figure 1:
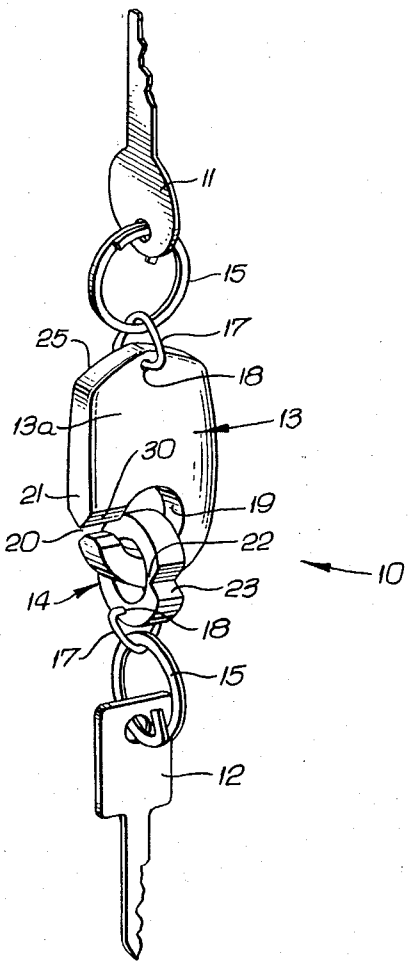
FIG. 1 is a perspective view of a separable holder for keys and the like embodying the novel features of the present invention, shown with two illustrative keys attached to the two key-holding means on the two bodies of the holder.

As shown in the drawings for purposes of illustration, the invention is embodied in a separable holder, indicated generally in the drawings by the reference number 10, for holding articles such as two keys 11 and 12 and normally keeping the keys together in a unitary assembly. The holder 10 has a main body 13 and a second body 14 that is separable from the main body, to uncouple the two keys from each other for separate use. For example, the two keys 11 and 12 may be the trunk and ignition keys of an automobile, and may be separated to leave the ignition key with a garage attendant while the trunk key is retained for security reasons.

Figure 5:
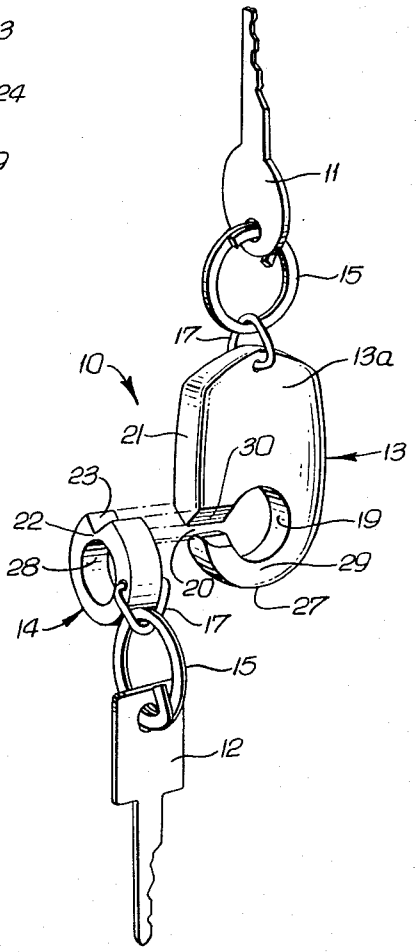
FIG. 5 is a perspective view similiar to FIG. 1 but showing the two bodies of the holder in the uncoupled condition.

As can be seen in FIGS. 1 and 5, the bodies 13 and 14 carry conventional key rings 15 to which the keys 11 and 12 are attached. These rings preferably are attached to the bodies by small connectors 17 that are fitted through holes 18 in the bodies and provide loose, swinging connections for the keys.

In accordance with the present invention, the main body 13 of the holder 10 is somewhat elongated and has its key-holding parts 15 and 17 at one end and a generally C-shaped opposite end portion with a central opening 19 and a relatively narrow passage 20 extending from the opening laterally through a side edge 21 of the main body. The detachable body 14 is a relatively thick and at least substantially continuous band having a portion 22 of reduced thickness that is sized and shaped to slide into and out of the passage 20 when the two bodies are in a particular relationship for uncoupling and recoupling. The second set of key-holding parts 15, 17 is positioned on this body in a manner to hold it away from the uncoupling position, normally, thereby to avoid inadvertent uncoupling. In addition, the parts are sized and shaped for a tight sliding fit during uncoupling, which further reduces the likelihood of accidental separation.

In the presently preferred embodiment of the invention, the detachable body 14 is a continuous circular ring, substantially thicker than the width of the passage 20, and the portion 22 of reduced thickness is a notched side of the ring, the notch 23 being located in one peripheral surface, herein the outside surface. The notch is V-shaped, and reduces the ring in the area indicated at 22 to a thin wall of approximately the same thickness as the minimum width of the passage 20.

The connector 17 is attached to the ring 14 at a point that is other than directly opposite the notch, preferably at a point about ninety degrees away from the notch around the ring, as shown. Because the ring 15 and the key 12 thereon will tend to hold the ring in a position other than the uncoupling position, this positioning of the connector assists in avoiding inadvertent uncoupling.

While the main body 13 may be formed with different shapes, it will be seen in the drawings that the preferred main body has two relatively wide and generally flat sides 13*a* and 13*b* that are joined by two elongated and relatively narrow side edges 21, and by opposite end edges 25 and 27. The edge 25 forming the connector-end of the main body, the upper end as viewed in the drawings, is shown as having a shallow inverted "V" shape, with the connector 17 attached near the vertex of the "V", while the opposite end, the lower end as viewed in the drawings, is shown as arcuate, concentric with the opening 19, which is circular.

For both aesthetic and functional reasons, the centerhole 28 of the ring 14 has substantially the same diameter as the opening 19 in the main body 13, and the arcuate end 27 of the main body has substantially the same curvature as the outside surface of the ring. Accordingly, the radial thickness of the ring is about the same as the radial thickness of the hook-like rib forming the lower end portion of the main body, between the opening 19 and the arcuate edge 27. This lower end portion is substantially narrower than the diameter of the centerhole 28 of the ring, and may be tapered in thickness toward the lower end, so that the ring swings freely on and rotates in the main body.

Figure 4:
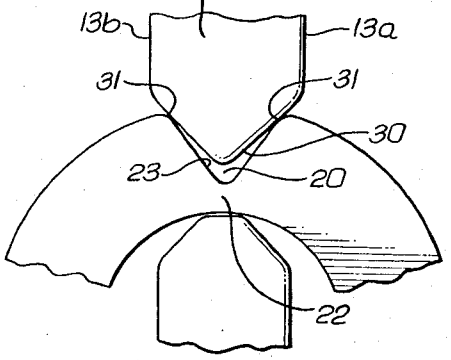
FIG. 4 is an enlarged fragmentary side elevational view taken from the left-hand side of FIG. 3.

As shown most clearly in FIG. 4, the side of the passage 20 that is engaged by the notch 23 during coupling and uncoupling (the upper side of FIG. 4) is shaped for tight sliding engagement with the notch, so as to avoid inadvertent uncoupling without unduly interfering with intentional coupling and uncoupling. For this purpose, this side of the passage is formed by a portion of the main body forming a finger having a V-shaped end 30 along which the walls of the notch 23 slide. The angle of the "V" of the notch, however, is different from the angle of the "V" of the finger, the notch angle being smaller by a few degrees so that the two V-shaped surfaces will not be in flat surface-to-surface contact, which would be likely to cause jamming or at least to make sliding difficult. Instead, the parts are engaged along narrow lines of contact, at 31, for less resistance.

As also can be seen in FIG. 4, the finger that forms the other side of the passage 20, and engages the inside of the ring 14 also is substantially V-shaped, tapering to a relatively narrow blunt end. The inner side of the ring slides over this end during coupling and uncoupling.

The parts of the main body 13 and the ring 14 are spaced for a slight "interference" fit, so that even the notched side of the ring will not pass freely through the passage. Some force is required during coupling and uncoupling, to produce a slight yielding of the surfaces, as permitted by the slight resiliance of the material used.

While a variety of different materials may be satisfactory, the preferred material is acrylic, that may be cast into a lightweight and very durable holder, with a high-quality finish and appearance. The upper end portions of the sides 13*a* and 13*b* of the main body provide space for decorative additions, such as advertising insignia or initials, which may be applied to the outer sides or embedded in the main body as part of the casting process. Of course, materials of different colors may be used for decorative purposes.

While the foregoing detailed description should be sufficient to provide an understanding of the use and operation of the key holder 10, a summary of operation may be useful in providing a better appreciation. FIG. 1 shows a normal, extended position of the coupled parts of the holder, with the key 12 on the ring 14 hanging downwardly and the notch 23 facing laterally away from one side of the holder. The ring 14 can rotate and swing freely in this condition, and as long as the thin wall 22 is not moved into the passage 20 in the main body, there is no danger of accidental separation of the two parts 13 and 14 of the holder.

Figure 2:
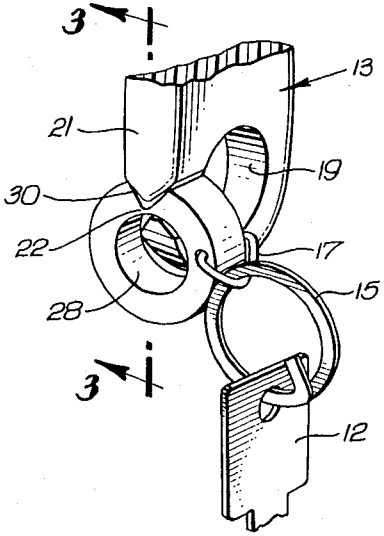
FIG. 2 is an enlarged fragmentary perspective view of the holder, similar to parts of FIG. 1, but with the parts moved to the relationship used for uncoupling and recoupling of the bodies.
Figure 3:
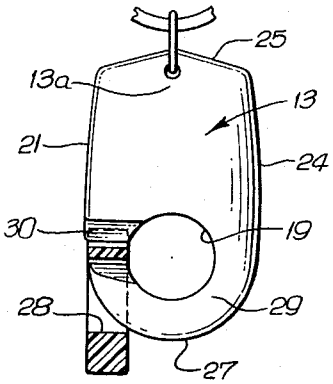
FIG. 3 is a fragmentary view of the holder in the condition shown in FIG. 2, partly in side elevation and partly in cross-section taken substantially along the line 3—3 of FIG. 2.

When separation is desired, however, it is easyto accomplish. The ring 14 is grasped in one hand, with the body 13 in the other, and is turned to bring the notch 23 into the opening 19 and into alignment with the V-shaped end 30. Then the notch is shifted toward and along the finger to move the thin wall 22 along the passage 20, sliding with a tight interference fit along the opening 19 (See FIGS. 2, 3 and 4).

When the ring 14 is free of the passage (FIG. 5), the keys 11 and 12 are freed for separate handling and use. Yet they may be reconnected simply and easily by aligning the notch 23 with the V-shaped end 30, as shown in FIG. 5, and then simply pressing the notched portion past the finger and into the opening 19. When the ring is released, the notched portion swings out of alignment with the passage, as a result of the urging of the key 12, and re-coupling is complete.

It will be evident from the foregoing that the present invention provides a novel separable holder for keys and the like that is effective in maintaining the two parts coupled together for normal use, quick and easy to operate for uncoupling and recoupling, and comfortable to grasp and hold. It also will be evident that, while one particular embodiment has been illustrated and described, various modifications and changes may be made without departing from the spirit and scope of the invention.

I claim as my invention:

1. A separable holder for keys and the like, comprising:

a first body having a first hole therein, one end portion on one side of said hole for connection to keys and the like, a second end portion on the opposite side of said hole in the form of a rib defining one side of said hole, and a passage having a finger defining one side of said passage and having a V-shaped end, said passage substantially narrower than the width of said hole extending from said hole to another side of said body;

a second body having a second hole therein surrounded by an at least substantially continuous wall that is thicker than said passage and thin enough to fit loosely in said first hole, said second hole being larger than the thickness of said rib to receive the latter in said second body, and said wall having a single notch creating a portion of reduced thickness that is sized and shaped to slide through said passage with a close fit, thereby to couple said bodies detachably together the angle of said notch being smaller than the angle of said V-shaped end and the passage being sized to permit the ring to slide through the passage with an interference fit along two lines, to reduce the possibility of inadvertent uncoupling and for avoiding jamming flat surface contact;

and first and second means for holding keys and the like, said first means being connected to said one end portion of said first body, and said second means being pivotally connected to said second body at a point other than directly opposite said portion of reduced thickness, thereby to tend to position that portion away from said passage.

2. A separable holder as defined in claim 1 wherein said first body is an elongated, block-like body having oppositely facing, relatively flat and wide sides, with said key-holding means adjacent one end and said first hole formed as a circular central opening in said second end portion, said rib being arcuate and extending around said central opening to said passage to form an arcuate end of said body opposite said one end, and said second body being a ring of approximately the same curvature and thickness as said rib defining a centerhole of approximately the same diameter as said first hole.

3. A separable holder for keys and the like having, in combination:

an elongated, main body having oppositely facing relatively flat and wide sides, elongated side edges, and first and second end edges forming oppositely facing ends of said body, said second end being arcuate and the end portion of said body adjacent said second end being generally C-shaped and forming a circular central opening and a relatively narrow passage extending from said opening laterally through one of said side edges;

a detachable body comprising a relatively thick continuous ring having an outside diameter that has a curvature similar to the curvature of said arcuate end, and a centerhole approximately the same size as said opening;

said ring having a V-shaped notch in one of its peripheral surfaces reducing the thickness of the ring at the bottom of the notch to approximately the width of said passage, and said main body having a finger with a V-shaped end on one side of the passage for sliding engagement with said notch, wherein the angle of said "V" of said finger is larger than the angle of said "V" of said notch, to avoid flat surface-to-surface sliding engagement, whereby the ring may be coupled to and uncoupled from the main body by aligning said notch with said V-shaped end and sliding the ring through the passage; and first and second key-holding means connected to said main and detachable bodies, respectively, for holding keys and the like on said bodies, said second key-holding means being connected to said ring at a point other than directly opposite said notch, thereby to tend to position the notch away from said passage.

4. A separable key holder as defined in claim 3 wherein said passage and said notch are sized and shaped to provide a sliding interference fit along two lines only, for avoiding jamming flat surface contact.

5. A separable holder for keys and the like, comprising:

an elongated, block-like main body having a generally C-shaped portion with an opening therein and a relatively narrow passage extending between said opening and an outer edge of said main body, said main body having an arcuate rib extending around said opening to said passage to form an arcuate end of said main body;

a detachable body having an at least substantially continuous wall that is thicker than the width of said passage with a portion of reduced thickness sized to pass through said passage with a close fit into said opening with a loose fit, said detachable body having a hole for loosely receiving a portion of said main body around said opening when said wall is in said opening;

said detachable body being a continuous ring of substantially square cross-section having a V-shaped notch in one of its peripheral surfaces forming the portion of reduced thickness, and said passage having a finger defining one side of said passage, said finger having a V-shaped end for engaging said notch as said portion slides through said passage, the angle of said notch being smaller than the angle of said V-shaped end and the passage being sized to permit the ring to slide through the passage with an interference fit along two lines, to reduce the possibility of inadvertent uncoupling and for avoiding jamming flat surface contact, said detachable body being approximately the same curvature and thickness as said rib to define said hole having approximately the same diameter as said opening; and first and second means on said main and detachable bodies respectively, for holding keys and the like on said bodies.

6. A separable holder as defined in claim 5 wherein said second key holding means is coupled to said detachable body at a location other than directly opposite said portion of reduced thickness thereby to tend to turn said portion away from said passage.

7. A separable holder as defined in claim 6 wherein said second key holding means pivotally passes through an aperture in said detachable body to permit said second key holding means to swing with respect to said detachable body.

* * * * *